US009196449B1

(12) United States Patent
Chang

(10) Patent No.: US 9,196,449 B1
(45) Date of Patent: Nov. 24, 2015

(54) FLOATING GRID ELECTRON SOURCE

(71) Applicant: FAR-TECH, Inc., San Diego, CA (US)

(72) Inventor: Xiangyun Chang, Miller Place, NY (US)

(73) Assignee: FAR-TECH, Inc., San Diego, CA (US)

( * ) Notice: Subject to any disclaimer, the term of this patent is extended or adjusted under 35 U.S.C. 154(b) by 0 days.

(21) Appl. No.: 14/672,166

(22) Filed: Mar. 28, 2015

Related U.S. Application Data

(60) Provisional application No. 62/062,137, filed on Oct. 9, 2014, provisional application No. 62/113,191, filed on Feb. 6, 2015.

(51) Int. Cl.
*H01J 23/16* (2006.01)
*H01J 31/04* (2006.01)

(52) U.S. Cl.
CPC ..... *H01J 31/04* (2013.01)

(58) Field of Classification Search
CPC ..... H01J 29/96
USPC ..... 315/3
See application file for complete search history.

(56) References Cited

U.S. PATENT DOCUMENTS 6,633,129 B2 * 10/2003 Mako ..... H01J 3/023 313/103 R
2002/0180362 A1 * 12/2002 Symons ..... H01J 23/087 315/3
2004/0036032 A1 * 2/2004 Leung ..... H01J 27/18 250/423 R
2004/0061456 A1 * 4/2004 Yu ..... H05H 9/00 315/505
2005/0035731 A1 * 2/2005 Secheresse ..... H05H 1/54 315/500
2011/0199027 A1 * 8/2011 Kim ..... H01J 37/077 315/370
2012/0229053 A1 * 9/2012 Yu ..... H05H 7/22 315/505

* cited by examiner

*Primary Examiner* — Jason M Crawford
(74) *Attorney, Agent, or Firm* — Elizabeth Kim Patent Law Offices LLC

(57) ABSTRACT

A system comprises: an RF cavity; a main emitter; a floating grid configured to capture a portion of the electron current emitted by the main emitter; and a discharging emitter in electrical contact with the floating grid and configured to discharge the floating grid. The floating grid and the discharging emitter are electrically insulated from the main emitter and from the RF cavity, when the RF cavity is not in operation. The DC bias of the floating grid is adjusted so that the ending emission phase of the electron beam from the floating grid occurs earlier than the starting phase of back-bombardment of the electrons in the RF cavity, thereby suppressing the back-bombardment of the electrons. A floating grid can be also placed between the RF drive grid and the cathode in an IOT, thereby suppressing arcing of the cathode in the IOT.

23 Claims, 11 Drawing Sheets

FLOATING GRID ELECTRON SOURCE

CROSS-REFERENCE TO RELATED APPLICATIONS

This application is based upon, and claims the benefit of priority under 35 U.S.C. §119(e) from, U.S. Provisional Patent Application Ser. No. 62/062,137, filed Oct. 9, 2014, entitled "Phase-Optimized Floating Grid Electron Source"; and from U.S. Provisional Patent Application Ser. No. 62/113,191, filed Feb. 6, 2015, entitled "Floating Grid Electron Source." The contents of the foregoing provisional applications are incorporated herein by reference in their entireties for all purposes as though fully set forth.

BACKGROUND

There is a need for high quality electron beams in a number of applications, including modern energy recovery linac (ERL) based applications, and high power, high efficiency RF (radio frequency) amplifiers. The need for high peak, high average current, and high quality electron beams is particularly strongly in facilities that perform scientific research in nuclear physics, for example the Relativistic Heavy Ion Collider (RHIC) at Brookhaven National Laboratory (BNL), and the Continuous Electron Beam Accelerator Facility (CEBAF) at the Thomas Jefferson National Accelerator Facility (JLab).

Typically, thermionic electron RF guns include a thermionic cathode, which is heated to create a stream of electrons via thermionic emission. Thermionic cathodes are capable of generating high quality beams with high peak and high average current, in a variety of vacuum electronic applications. However, thermionic cathodes cannot generate such beams in RF cavities. They have thus been replaced by photocathodes for most RF gun applications that require high-brightness electron beams. Not only are photocathode sources very expensive, but also it is very hard to obtain high average current with them. Further, the lifetimes of photocathodes are also very short.

A major reason that prevents a thermionic cathode from generating high-brightness, high average current beam in RF guns is the un-controlled phase of the emission, which spans from 0° to 180° of an RF cycle, and which causes back-bombardment.

DETAILED DESCRIPTION

Illustrative embodiments are discussed in this application. Other embodiments may be used in addition or instead.

It should be understood that the present application is not limited to the particular embodiments described, as such may vary. Also, the terminology used herein is for the purpose of describing particular embodiments only, and is not intended to be limiting, since the scope of the present application will be limited only by the appended claims.

Unless defined otherwise, all technical and scientific terms used herein have the same meaning as commonly understood by one of ordinary skill in the art to which this invention belongs. Although any methods and materials similar or equivalent to those described herein can also be used in the practice or testing of concepts described in the present application, a limited number of the exemplary methods and materials are described herein.

Where a range of values is provided, each intervening value, to the tenth of the unit of the lower limit unless the context clearly dictates otherwise, between the upper and lower limit of that range and any other stated or intervening value in that stated range is encompassed within the invention. The upper and lower limits of these smaller ranges may independently be included in the smaller ranges is also encompassed within the invention, subject to any specifically excluded limit in the stated range. Where the stated range includes one or both of the limits, ranges excluding either or both of those included limits are also included in the invention.

In the present application, methods and systems are described relating to novel techniques which can effectively suppress the back-bombardment in RF cavities. These techniques can be used to generate high-peak, high-average current, and low emittance bunched electron beams, in a cost-effective manner. In some embodiments, these techniques may be applied by generating magnetized bunched beams, which are required for electron cooling in medium to high energy bunched proton (or ion) beams.

Figure 1A:
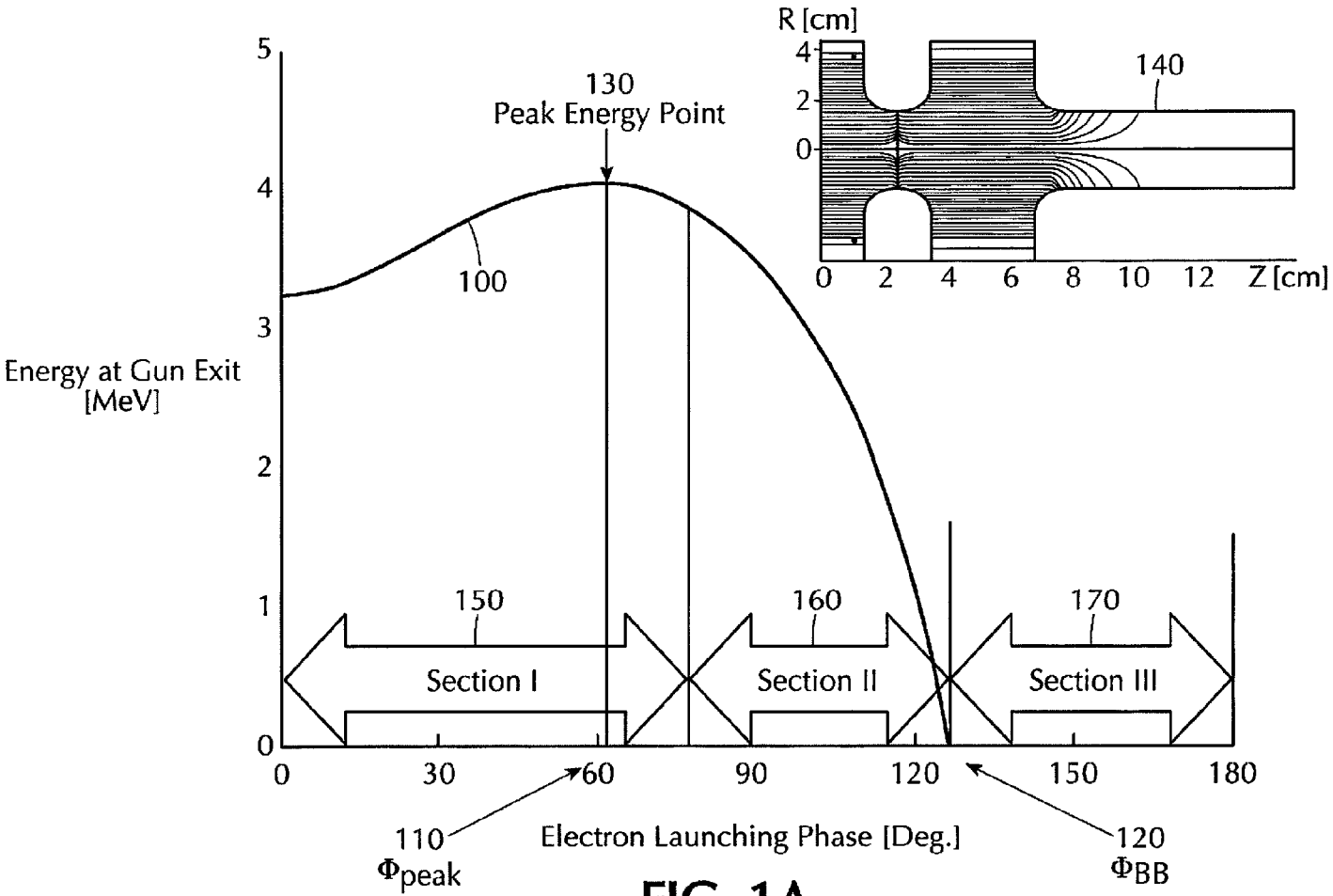
FIG. 1A illustrates a curve representing the electron energy at an RF gun exit as a function of the electron launching phase on the cathode, in a typical RF gun, a 1.5 cell RF cavity, shown on the right hand top side.
Figure 1B:
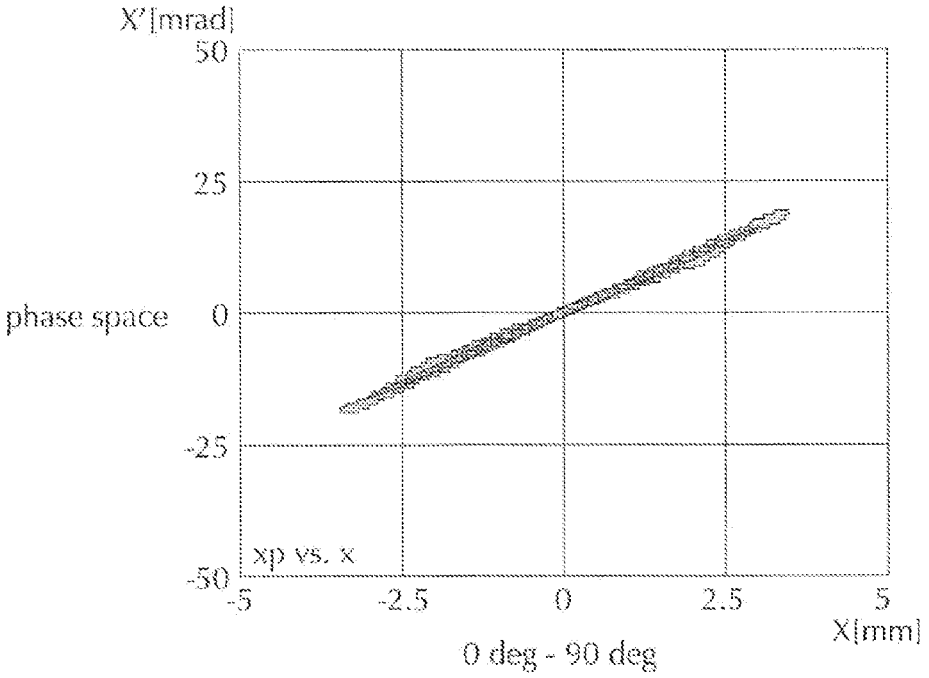
FIG. 1B illustrates the phase space of electrons launched from an initial phase of section I (between 0 degrees to a little higher than $\phi_{Peak}$, the peak energy initial phase) shown in FIG. 1A.
Figure 1C:
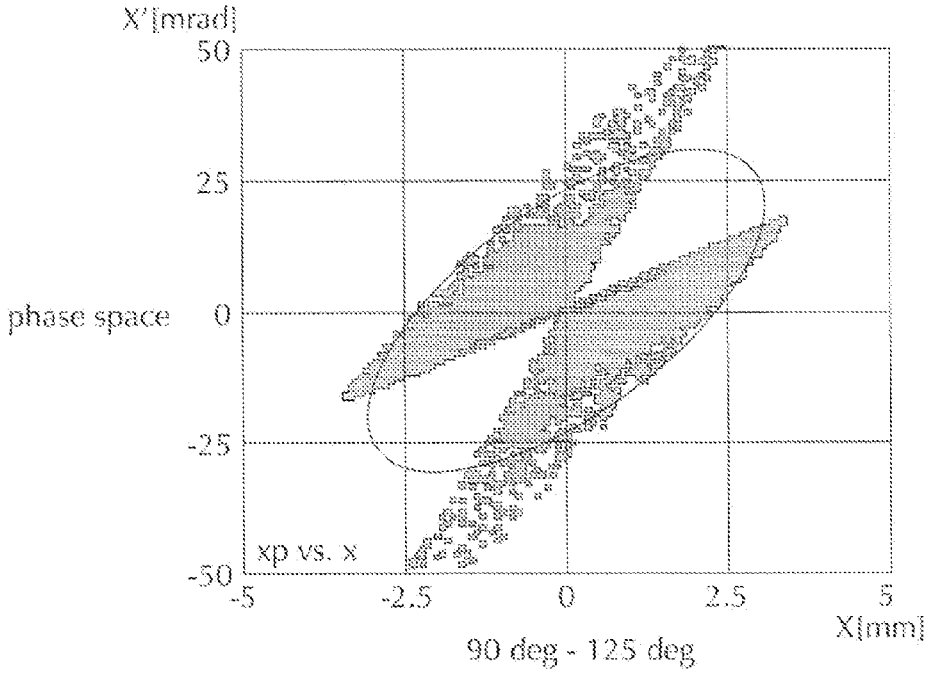
FIG. 1C illustrates the phase space of electrons launched from an initial phase of section II shown in FIG. 1A.

The phenomenon of back-bombardment is illustrated in FIGS. 1A-1C. FIG. 1A illustrates a curve 100, generated by plotting the electron energy at the RF gun exit, as a function of the electron launching phase (also referred to as initial phase) on a thermionic cathode.

In the present application, the terms "launching phase" and "initial phase" have the same meaning, and are used interchangeably. The electron launching phase (or electron initial phase) represents the phase when the electron leaves the cathode. The RF field, i.e. the electric field in the RF cavity, is sinusoidal and varies its phase from 0° to 360°. From 0° to 180°, the field is in the direction of the accelerating electron beam, and is shown as a positive field in the notation used in this application. During this phase, therefore, the electrons leave the cathode surface. From 180° to 360°, the field reverses direction.

In FIG. 1A, $\phi_{Peak}$ (indicated with reference numeral 110) stands for the electron initial phase at the peak energy point 130, whereas $\phi_{BB}$ (indicated with reference numeral 120) stands for the electron initial phase at the start of back-bombardment.

The curve 100 in FIG. 1A was simulated based on an S band 1.5 cell RF cavity 140, shown in the right top corner of FIG. 1A. The RF cavity 140 has a peak field on axis of 100 MV/m. The values of the phases $\phi_{Peak}$ and $\phi_{BB}$ are mainly determined by the cell lengths and the field strength in the RF cavity 140. The higher the field in the RF cavity 140, and the shorter the lengths of the cells (especially for the first cell), the closer $\phi_{Peak}$ is to 90° and the closer $\phi_{BB}$ is to 180°.

FIG. 1B illustrates the phase space at gun exit of an electron beam (in the RF cavity 140) having an electron launching phase in a range indicated in FIG. 1A with reference numeral 150 as "Section I." As seen in FIG. 1B, Section I covers an electron launching phase between 0 degree and a little higher than $\phi_{Peak}$. FIG. 1B shows that the electrons launched from an initial phase in the range of Section I experience approximately the same strengths of RF focusing or defocusing, and therefore the emittance of these electrons is small.

FIG. 1C illustrates the phase space of the same electron beam having an electron launching phase in a range indicated in FIG. 1A with reference numeral 160 as "Section II". Space charge is not included. Electrons launched from an initial phase covered by the range indicated as section II (160) in FIG. 1A experience a wide range of different RF focusing or defocusing, compared to section I electrons, thereby degrade the overall emittance.

The electrons launched from an initial phase indicated in a range indicated in FIG. 1C with reference numeral 170 as "section III" cannot escape from the RF gun, so strike back and impinge upon the cathode. This is the phenomenon called back-bombardment. Back-bombardment occurs under a reversed field, and rapidly heat up the cathode, with undesirable consequences.

The back-bombardment power density depends on a number of factors, including cavity structure, cathode emission density, and field strength. Generally, it ranges from a few $kW/mm^2$ to tens of $kW/mm^2$. Such huge thermal power density causes rapid cathode temperature increase during each RF macro pulse. This temperature increase, in turn, causes the current to go up and the beam energy to go down during the RF macro pulse, which is undesirable for most applications. The back-bombardment effect limits the RF macro pulse length to be very short, typically a few μs. Further, back-bombardment limits the average current.

An example of application of the methods and systems disclosed in this application is the generation of state-of-the-art electron beams for industrial or research laboratories. For example, JLab requires a magnetized beam with a high bunch charge (up to 2 nC) and high average current (above 100 mA) and high bunch repetition rate (75 MHz). For this application, a 75 MHz normal conducting RF cavity may be used. The problem of back-bombardment, which limits the average current produced by these sources, must be addressed.

In order to suppress the above-described undesirable back-bombardment beam, deflecting magnets have been conventionally used. The suppression resulting from this technique is finite and limited, however.

An RF electron gun that uses a thermionic cathode typically includes: a thermionic cathode, which is heated to create a beam of electrons via thermionic emission; an RF cavity generating an RF electric field to accelerate the electrons; and some beam optics to control the beam.

In some embodiments of the present application, the accelerating gap in the RF cavity is designed to be short compared to the RF wavelength (λ) of the RF cavity, to reduce the back-bombardment problem. In particular, the accelerating gap in the first cell of the RF cavity is designed to be short compared to the RF wavelength (λ) of the RF cavity. In this way, not only can a high field gradient be obtained on the cathode at limited RF power, but also $\phi_{Peak}$ can be pushed close to 90° and $\phi_{BB}$ be pushed close to 180°.

In some embodiments, the accelerating gap in the first cell of the RF cavity is designed to be no more than ¼λ. In some embodiments, the accelerating gap in the first cell of the RF cavity is designed to be no more than ⅕λ, 1/20λ, or 1/200λ. A wide range of sizes of the accelerating gap may be used in different designs.

While shortening the length of the accelerating gap can reduce back-bombardment, such a measure is not enough, by itself, to suppress back-bombardment.

In some embodiments of the present application, a floating grid technique is disclosed that can suppress back-bombardment of electrons generated by RF electron guns.

Figure 2A:
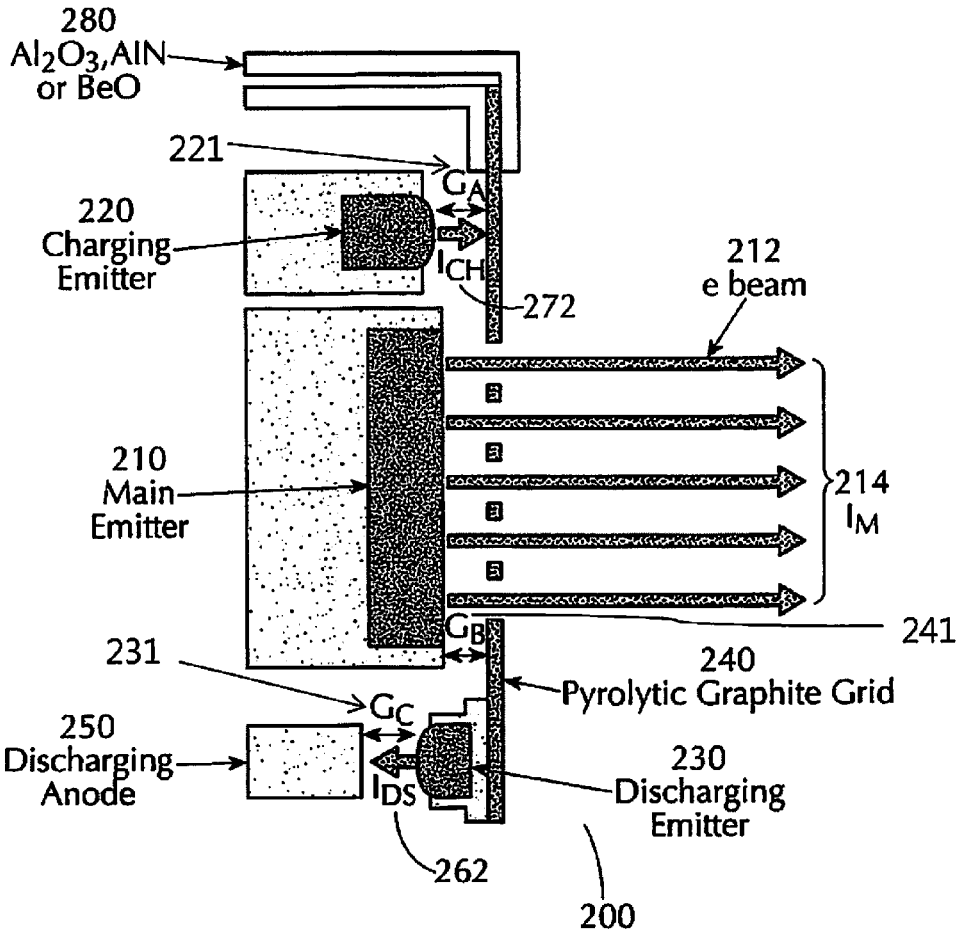
FIG. 2A illustrates a floating grid structure in accordance with some embodiments of the present application.

FIG. 2A illustrates a floating grid structure 200, in accordance with some embodiments of the present application. In the embodiment illustrated in FIG. 2A, the floating grid structure 200 includes a main emitter 210, a charging emitter 220, a discharging emitter 230, a grid 240, and a discharging anode 250.

As shown in FIG. 2A, the grid 240 is supported by an insulator 280, which in this application will be referred to as an insulator supporter 280. The grid 240 is electrically insulated from the other parts, i.e. from the main emitter 210, the discharging anode 250, the charging emitter 220, and the RF cavity, during non-operating periods in which the RF cavity is not in operation. The material for the insulator supporter 280 may be $Al_2O_3$ (Aluminum Trioxide), MN (Aluminum Nitride), or BeO (Beryllium Oxide). Different insulating materials known in the art may also be used, in other embodiments of the present application. While the illustrated embodiment shows only one insulator supporter 280, there can be more than one insulator supporters located evenly around the edge ring of the floating grid 240, as long as they do not interfere with the charging emitter 220 or discharging emitter 230.

The main emitter 210 emits a main emitter current $I_M$, indicated in FIG. 2A with reference numeral 214. The main emitter 210 is designed such that only a little portion of its emission beam 212, $I_{cap}$, can be captured by the grid 240. By adjusting the DC bias of the floating grid, the main emitter current $I_M$ is adjusted. This can be used to adjust the RF output power.

In the illustrated embodiment, the charging of the grid 240 is mainly contributed by the charging emitter 220, which has a charging current $I_{CH}$ indicated with reference numeral 272. The charging emitter 220 is configured to charge the floating grid 240 during the electron emission period in which the main emitter 210 emits electrons.

The discharging of the grid 240 occurs through the discharging emitter 230, which has a discharging current $I_{DS}$, indicated with reference numeral 262. $I_{cap}$ is also considered part of the charging current $I_{CH}$ 272. A small $I_{cap}$ allows a small minimum of $I_{CH}$ 272.

While the illustrated embodiment shows a single floating grid 240, in other embodiments a plurality of floating grids 240 may be provided. Also, a plurality of emitters (main emitter 210 and/or charging emitter 220 and/or discharging emitter 230) may be provided, in other embodiments of the present application. The main emitter 210, the charging emitter 220, and the discharging emitter 230 may be a thermionic cathode, and/or a field emitter array.

To simplify the analysis, it may be assumed that the electrons take negligible time traveling in the gaps, namely gap $G_A$ (indicated in FIG. 2A with reference numeral 221), gap $G_B$ (indicated in FIG. 2A with reference numeral 241) and gap $G_C$ (indicated in FIG. 2A with reference numeral 231), because of their short distances. It may also be assumed that $I_{CH}$ and $I_{DS}$ are constant during their charging or discharging periods and have sharp turn on or off edges at field crossover point. Assuming that the grid 240 is charged with net charge of $Q_{Net}$ on average at equilibrium, $Q_{Net}$ is determined by the RF field $E_{RF}$ in the RF cavity 140, with peak RF field value, Ep, $I_{CH}$, $I_{DS}$, and grid geometry. $Q_{Net}$ can be negative, zero, or positive. $Q_{Net}$ creates a DC field in grid gap, $E_{DC}=kQ_{Net}$, where k is determined by grid geometry. The net field ($E_{Net}$) is:

$$E_{Net}=E_{DC}+E_{RF}.$$

Figure 2B:
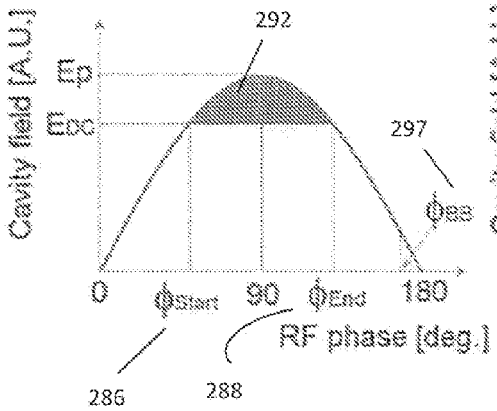
FIG. 2B illustrates the emission from the floating grid structure illustrated in FIG. 2A, at small $I_{CH}$ (charging current) and $I_{DS}$ (discharging current), and with negative net charge at equilibrium.

FIG. 2B illustrates the emission from the floating grid structure 200 illustrated in FIG. 2A, with negative net charge at equilibrium and a small value of $I_{CH}$ or $I_{DS}$. As illustrated in FIG. 2B, $Q_{Net}$ is negative such that $E_{DC}$ suppresses the emission from the charging and main emitters 220 and 210. At phase $\phi_{Start}$, indicated in FIG. 2B with reference numeral 286, $E_{Net}$ becomes positive and the beams from the main emitter 210 enters the RF cavity. At the same time, the charging emitter 220 starts charging up the grid 240.

At phase $\phi_{End}$, indicated in FIG. 2B with reference numeral 288, $E_{Net}$ changes polarity and the emissions from the charging and main emitters 220 and 210 stop. Meanwhile, the discharging emitter 230 starts discharging the grid 240 until $\phi_{Start}$ in the next RF cycle. The emission area, shown with reference numeral 292, is symmetric to 90° when $I_{CH}$ and $I_{DS}$ are small, as shown in FIG. 2B. The higher the $E_{DC}$, the narrower the emission window. When $E_{DC}$ is high enough, $\phi_{End}$ 288 can occur earlier than $\phi_{BB}$, which is indicated in FIG. 2B with reference numeral 297. In this case, the back-bombardment from the RF cavity is suppressed. The charging emitter 220 and the discharging emitter 230 have the role of adjusting the level of $E_{DC}$ and maintaining it in a dynamic equilibrium.

The DC bias of the floating grid is thus adjusted so that the ending emission phase of the electron beam from the floating grid occurs earlier, compared to the starting phase of back-bombardment of the electrons in the RF cavity, thereby eliminating the back-bombardment of the electrons and suppressing the poor quality electrons. This allows the thermionic RF gun to operate at CW (continuous wave) mode to achieve high average current, low emittance beam.

Figure 2C:
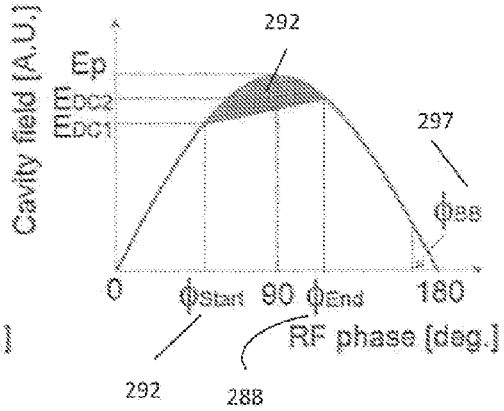
FIG. 2C illustrates the emission from the floating grid structure illustrated in FIG. 2A, at large $I_{CH}$ and $I_{DS}$.

FIG. 2C illustrates emission from the floating grid structure of FIG. 2A, at large $I_{CH}$ and $I_{DS}$. At large $I_{CH}$ and $I_{DS}$, the grid net charge change during each charging cycle, given by $Q_{Chg}=\int_{\phi_{Start}}^{\phi_{End}} I_{CH}dt$, as well as the grid net charge change during each discharging cycle, given by $Q_{Dsc}=\int_{\phi_{End}}^{360+\phi_{Start}} I_{DS}dt=Q_{Chg}$, will cause the center phase of the emission window to move to lower initial phase. This is illustrated in FIG. 2C where $E_{DC2}-E_{DC1}=kQ_{Chg}$. At equilibrium, $Q_{Chg}=Q_{Dsc}$ and $\phi_{End}$ 288 is always larger than 90°.

As back-bombardment is eliminated, the RF cavity can operate at CW mode. In this way, the average current can be improved enormously.

As explained above, the values of the phases $\phi_{Peak}$ and $(I)_{BB}$ are mainly determined by the cell lengths and the field strength in the RF cavity. In some embodiments, the RF cavity is designed so that the starting phase of the electron back-bombardment in the RF cavity is more than 120 degrees, and the peak energy initial phase of the RF cavity is more than 50 degrees. In some embodiments, the RF cavity is designed so that the starting phase of the electron back-bombardment in the RF cavity is more than 140 degrees, and the peak energy initial phase of the RF cavity is more than 70 degrees. In some embodiments, the RF cavity is designed so that the starting phase of the electron back-bombardment in the RF cavity is more than 170 degrees, and the peak energy initial phase of the RF cavity is more than 80 degrees. In other embodiments, the RF cavity may be designed with other ranges for $\phi_{Peak}$ and $\phi_{BB}$.

In some embodiments of the present application, a floating grid structure is designed that is capable of generating 2 nC bunch charge, 75 MHz, magnetized beam for cooling ion beams, such as the ion beams generated by Jlab.

In one embodiment of this application, a 75 MHz normal conducting RF cavity is used. Other types of RF cavities may be used in different embodiments of this application. Following is a description of methods and systems for designing a floating grid cathode capable of generating a 2 nC bunch charge, 75 MHz, magnetized beam.

Figure 3A:
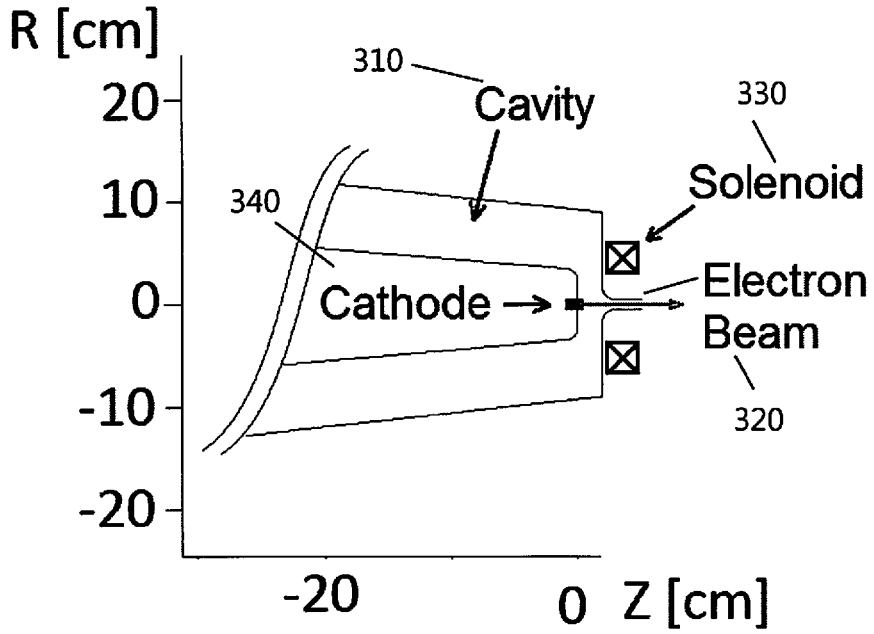
FIG. 3A illustrates a normal conducting 75 MHz quarter wave CW RF cavity for generation of a magnetized beam.

FIG. 3A schematically illustrates a normal conducting 75 MHz quarter wave CW RF cavity 310 for generating a magnetized electron beam 320. In particular, FIG. 3A shows part of a normal conducting 75 MHz quarter wave cavity. While this specific example is discussed for illustrative purposes, the methods and systems disclosed in this application works for other types of RF cavities, either normal conducting or superconducting, CW or pulsed, for generation of magnetized or non-magnetized beam.

A solenoid 330 near the cathode 340 is used to magnetize the electron beam 320 that is emitted from the cathode 340. Assuming the peak field on axis is 10 MV/m in the example of FIG. 3A, the total RF power loss on the wall of the RF cavity 310 will be 43 kW and the peak power density is only 5.2 W/cm$^2$.

Figure 3B:
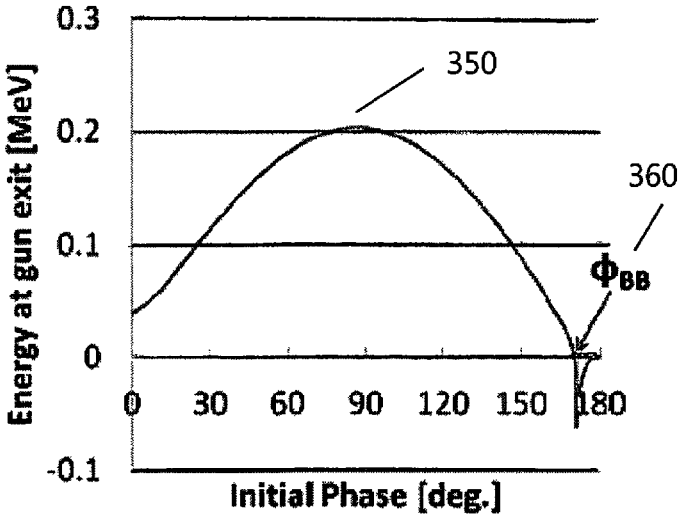
FIG. 3B is a plot of the energy at gun exit versus the initial phase at 10 MV/m of peak field on axis, for the RF cavity of FIG. 3A.

FIG. 3B is a plot 350 of the energy of the beam at gun exit as a function of initial phase at 10 MV/m of peak axis field. Negative energy indicates back-bombardment. The accelerating gap is very small, 2 cm, compared to the RF cavity wavelength, 4 m. As shown in FIG. 3B, the peak energy initial phase is thus very close to 90° (87°); and $\phi_{BB}$ (indicated with reference numeral 360), the electron initial phase at the start of back-bombardment, is 170°. Assuming the cathode 340 is operating traditionally at CW mode, and assume the output average current (initial phase between 0° to 170°) is 100 mA, the back-bombardment power is estimated to be about 100 W, which is too high.

Figure 3C:
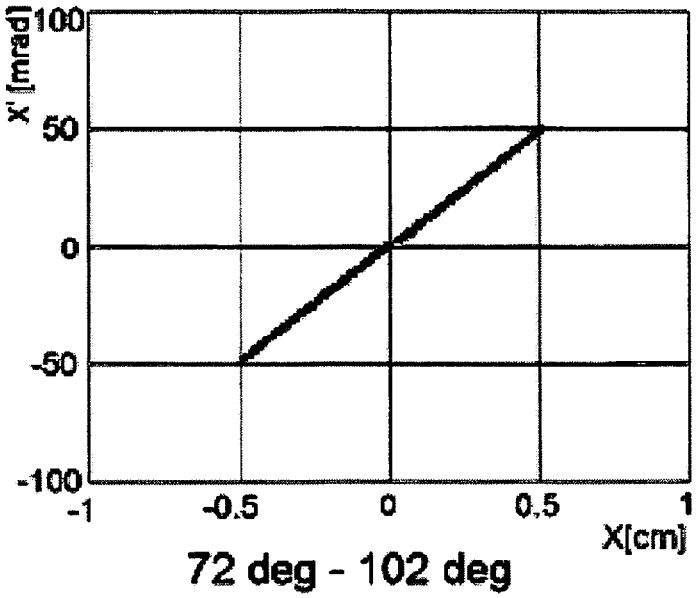
FIG. 3C illustrates the phase space of the beam at the exit of the RF cavity illustrated in FIG. 3A, with initial phase within 87°±15°

FIG. 3C illustrates the phase space at cavity exit of the beam 320 with initial phase within 87°±15°. In the illustrated embodiment, the spot size on the cathode 340 is 6 mm in diameter. Space charge is not included in FIG. 3C. The plot of the phase space at gun exit (without considering the space charge reflects the increase in emittance due to the time dependent RF focusing or defocusing. It is very small (0.4 mm·mrad in FIG. 3C) for a large window centered from the peak energy phase.

As seen in the above-discussed figures, by adjusting the DC bias of the floating grid 240 so as to make the ending emission phase of the electron beam from the floating grid 240 occur earlier, compared to the starting phase of back-bombardment of the electrons in the RF cavity, the back-bombardment electron beam is eliminated, and the poor quality beam is suppressed. Eliminating the back-bombardment of the electrons and suppressing poor quality electrons allows the thermionic RF gun to operate at CW mode, so that a high average current, low emittance beam can be obtained.

Figure 4A:
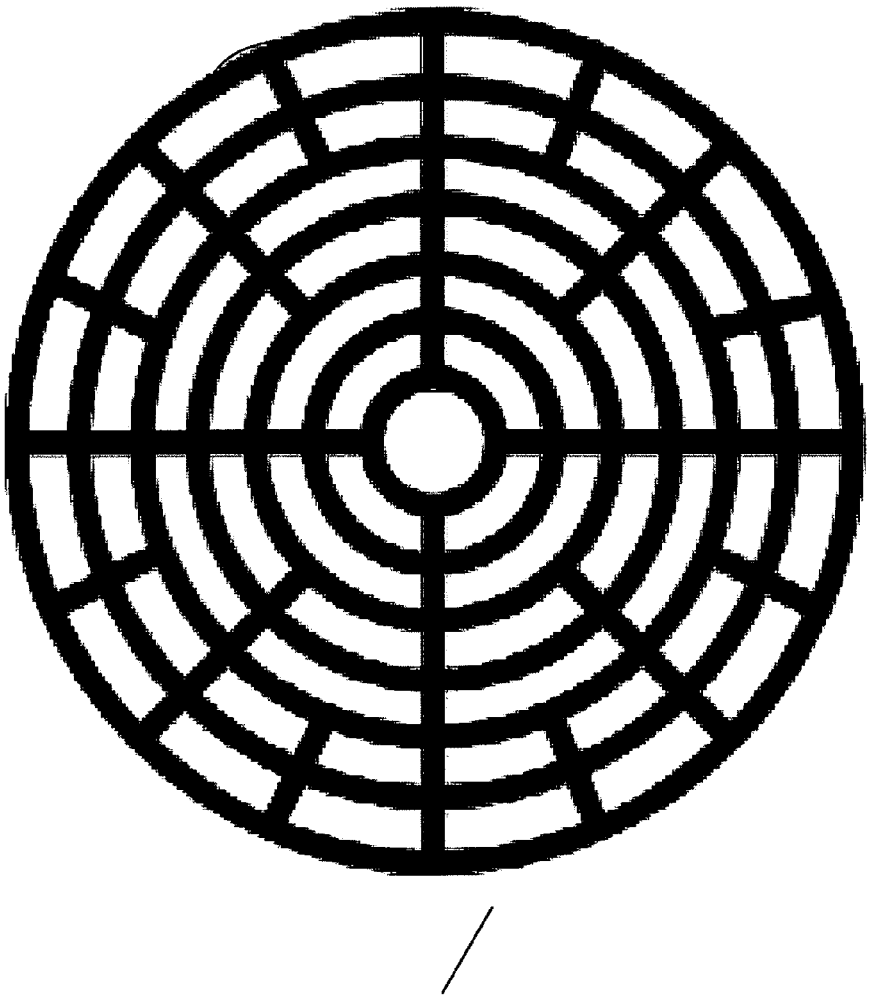
FIG. 4A illustrates one example of a grid design for the grid structure illustrated in FIG. 2A.

Presented below are further details of each individual component of the floating grid structure 200, discussed above in conjunction with FIG. 2A. One example of grid design for the grid structure 200 in FIG. 2A is illustrated in FIG. 4A. In some embodiments, the grid 240 may be made of pyrolytic graphite, which can operate at very high temperatures (greater than about 3000° C.) and has very high thermal conductivity, comparable to that of diamond. In other embodiments, the grid 240 may be made of other high temperature materials, including without limitation carbon, tantalum, tungsten, and molybdenum.

The design of the floating grid 240 may be a net pattern including a grid contour and a mesh. The grid contour and mesh may have a shape such as a circle, a square, a concentric segment, and a slit. The grid design shown in FIG. 4A is a grid 240 with a concentric circles structure. In the illustrated embodiment, the wires have a width and a thickness of 125 μm, and the gap between adjacent latitude wires is 250 μm. The radius of the grid is $R_G$=3 mm. Fabrication of this type of grid is well known in the vacuum tube industry, and the pertinent fabrication technique is well developed.

It is to be understood that in other embodiments, different sizes may be adopted for the width and thickness of the wires, the gap between adjacent latitude wires, and the radius of the grid. Also, in other embodiments, the segment shape can be different. Many different shapes, such as squares, long slits, other variations, or combinations thereof, can be used.

The main heating sources for the grid 240 include, without limitation: RF current heating ($P_{RF}$), thermal radiation from the charging and main emitters ($P_{Rad(C)}$), and the heating power from charging current ($P_{Chg}$). The heat on the grid 240 is mainly dissipated via thermal conduction through the insulator supporter ($P_{Cnd}$), and via grid thermal radiation ($P_{Rad(G)}$).

As the grid 240 is electrically floating in the RF cavity, there is no transverse RF current. The little current along beam axial direction causes negligible heat due to its small thickness, so, $P_{RF}$ is neglected. This is one of the advantages of a floating grid. For the grid dimensions recommended above, $P_{Rad(C)}$ is estimated to be ~5 W. Assuming the emission window of initial phase is ±15°, at Ep=10 MV/m, the average $E_{Net}$ during charging period is found to be 0.23 MV/m. Assume $\overline{I_{CH}}$=1 mA, then $P_{Chg}$≈0.06 W.

The conduction heat through the insulator supporter 280, $P_{Cnd}$, is determined by the dimensions of the supporter. Assume the insulator supporter 280 is made up of alumina (having maximum use temperature of 2000K) with 3 mm in diameter and 3 mm in height, the thermal conductivity drops to 5 W/mK at high temperature. The temperature drop on the insulator supporter 280 is about 85 K/W. By using Aluminum Nitride (having a maximum use temperature of 2000K) or Beryllium Oxide (having a maximum use temperature of 2400 K), more power can go through the insulator supporter 280. The above calculations indicate that the grid temperature is mainly determined by radiation and can be adjusted by the insulator supporter 280.

Figure 4B:
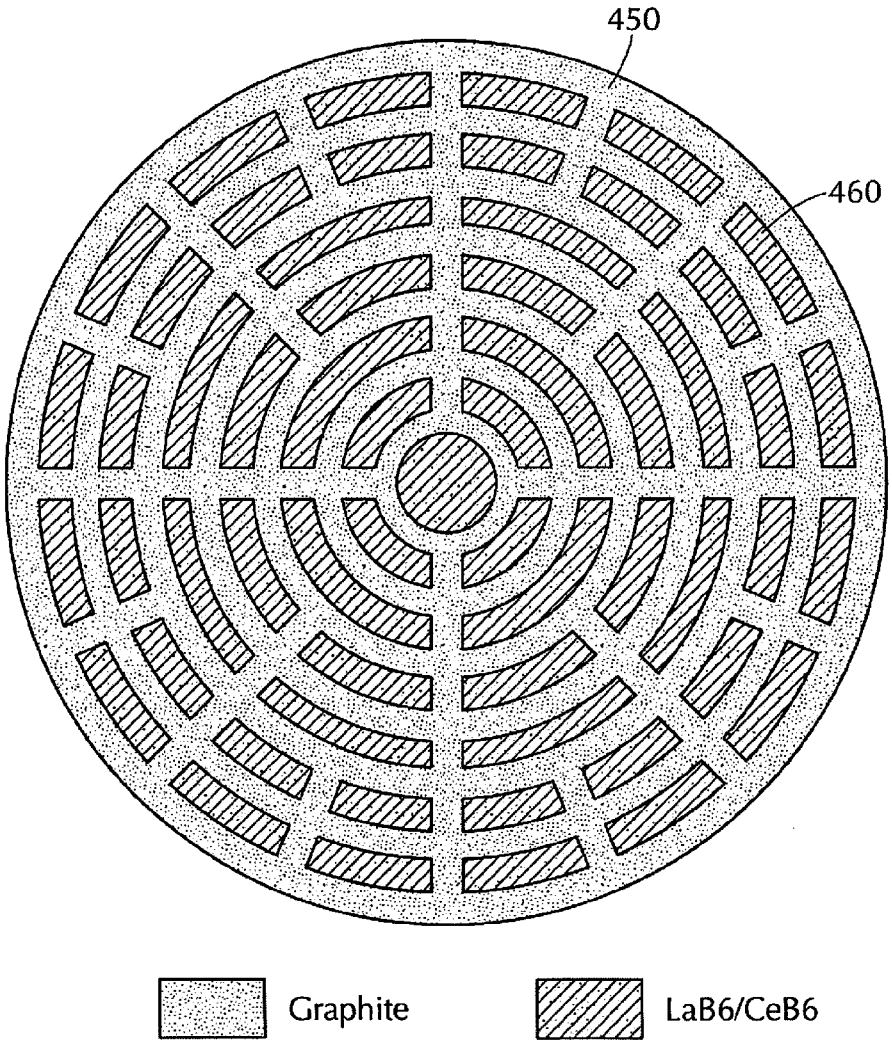
FIG. 4B illustrates one example of a main emitter design for the grid structure illustrated in FIG. 2A.

FIG. 4B illustrates one example of the design for the design of the main emitter. The frame 450 in black color, shown in FIG. 4B on the main emitter, is made up of graphite to prevent electron emission from those areas. The frame 450 can also be made of other high temperature materials. In this embodiment, the main emitter is masked with the same net pattern as the grid 240, and the mask (or frame) 450 is made of the same or similar high-temperature material as the grid 240, including without limitation carbon, tantalum, tungsten, and molybenum.

The wires in the frame 450 shown in the illustrated embodiment have a width of about 175 μm. This width chosen to prevent the electrons from the main emitter from striking the grid. The mosaic shown in striped pattern and indicated with reference numeral 460 in FIG. 4B is the main emitter. The main emitter 460 can be formed of $LaB_6$, or $CeB_6$. In some embodiments, $CeB_6$ may be better than $LaB_6$. Other materials may be used to form the emitter 460. Also, other types of emitters may be used, including without limitation field emitters.

In embodiments in which $LaB_6$ is used, one way of fabricating the main emitter is to engrave the large surface $LaB_6$, to the grid pattern and allow some tolerance, with laser beam, then inlay the grid-like frame 450 into the engraving. Other fabrication methods are also possible.

$LaB_6$ has low work function (~2.65 eV), the current density will be 15 A/cm$^2$ at operating temperature of 1800 K from Richardson's Law. The effective emission area is about 50% of the main emitter area, which is 0.14 cm$^2$, main current during emission period $I_M$≈2.1 A. The bunch charge will be $$Q_{BCH} = I_M \frac{\phi_{End} - \phi_{Start}}{2\pi f} = 2.3nC,$$

and the average current will be 175 mA. These parameters are sufficient for the goals set forth above.

In some embodiments of the present application, the main emitter 210 participates in the charging process. For example, it can block some of the micro-windows on edge of the grid 240 such that the emitted electrons are captured by the grid 240. In these embodiments, a charging emitter is not needed. The drawback is that the charging current cannot be adjusted independently.

In embodiments in which an independent charging emitter is used, the charging emitter 220 may be designed as illustrated in FIG. 2A. In one embodiment, an $LaB_6$ emitter with diameter of 1 mm may be used as the charging emitter 220. With this dimension and operating temperature, $\overline{I_{CH}}$ was about 1 mA. Assuming the charging beam spot size on grid is also 1 mm in diameter, the peak power density on that spot was 8 W/cm$^2$. $\overline{I_{CH}}$ can be adjusted by adjusting the charging emitter temperature through an independent heater or cooler. It should of course be understood that this embodiment is discussed for illustrative purposes only, and many other embodiments may be used instead. Many other related embodiments are possible.

Turning now to the discharging emitter 230, the discharging period (330° for the current design in the illustrated embodiment) is much longer than charging period (30° for current design). Also, due to the Schottky effect, a much higher field during discharging causes higher current density enhancement than that during charging, so the discharging emitter 230 with the same emitter of charging emitter 220 causes much more $\overline{I_{DS}}$ than $\overline{I_{CH}}$.

Heat dissipation is another issue to be considered. A discharging beam heats up the discharging anode 250. The discharging anode 250 can be cooled independently. As the surface areas of the charging emitter 220 and the discharging emitter 230 are much smaller than the surface area of the grid 240, their voltage is mainly determined by the main emitter gap $G_B$ (241). The average voltage within the discharging emitter gap $G_C$ (231) is found to be $\overline{V_{DS}}$=2640V in this design, where the gap $G_C$ is the distance between the discharging emitter 230 and the discharging anode 250. The heating power on the discharging anode 250 is: $P_{DS}=\overline{I_{DS}V_{DS}}=\overline{I_{CH}V_{DS}}=2.6$ W, much larger than the charging power $P_{Chg}$.

It is preferable to use a large area emitter to reduce the peak power density at hot spot on discharging anode 250. In some embodiments, an emitter with about 2 mm of diameter may therefore be chosen as the discharging emitter 230. This requires that the discharging emitter temperature be around 1450 K (current density of 0.16 A/cm$^2$) to have $\overline{I_{DS}}=1$ mA. The peak power density at hot spot on the discharging anode 250 is 80 W/cm$^2$.

Adjusting the average discharging current (i.e. current from the discharging emitter), $\overline{I_{DS}}=Q_{DSC}f$, can be achieved by adjusting the discharging emitter 230's temperature, or the field during discharging ($E_{DSC}$). The temperature of the discharging emitter 230 can be adjusted by means of radiation (to adjust discharging anode temperature), conduction (to adjust temperature of its support) or laser beam heating. In other words, the temperature of the discharging emitter 230 is controllable through a laser beam whose average power is adjustable, and/or conduction through temperature controlled support, and/or radiation from temperature controlled discharging anode 250. $E_{DSC}$, and thus $I_{DS}$, can be controlled by adjusting the length of the gap $G_C$ (i.e. the distance between the discharging emitter and the discharging anode), and/or by applying a DC field on the discharging anode 250 to adjust the DC bias of the discharging anode 250.

In one embodiment, a simple method of adjusting $I_{DS}$ is through laser heating and was attempted in this design. $I_{CH}$ and $I_{DS}$ are correlated, thus adjusting one of them will affecting the other one. For example, increasing $I_{DS}$ tends to increase $Q_{DSC}$, then $E_{DC}$ is lowered, and $E_{Net}$ during charging is increased. Therefore $I_{CH}$ is increased, the charging window is also widened, so $Q_{Chg}$ is increased. Meanwhile, $E_{Net}$ during discharging is lowered and the discharging window is narrowed, this causes the reduction of $Q_{DSC}$, eventually they reach a new equilibrium ($Q_{DSC}=Q_{Chg}$). This indicates that the system is a negative feedback system and in most case is stable.

The difference $E_{DC2}-E_{DC1}$, illustrated in FIG. 2C, can now be estimated. Assuming the total grid surface area, including the charging/discharging areas, to be 20 mm$^2$, the capacitance is about $C_G=0.71$ pF at $G_A=G_B=G_C=250$ μm, $Q_{Chg}=Q_{DSC}=1$ mA×1/f=13 pC. Therefore, $E_{DC2}-E_{DC1}\approx 0.075$ MV/m, about ⅓ of $E_{Net}$ during charging, and the emission looks more like the illustration in FIG. 2C.

The DC bias of the floating grid 240 can thus be adjusted by adjusting the current from the main emitter 210, and/or by adjusting the current from the charging emitter 220, and/or by adjusting the current from the discharging emitter 230.

The lifetime of the grid is mainly determined by the evaporation of the $LaB_6$ material. The evaporation rates of charging/discharging emitters are a few orders slower than that of the main emitter due to their relatively low temperatures. The lifetime will be determined by the main emitter lifetime. The estimation of the lifetime depends on how the evaporation loss limit is defined. Assuming that the limit is defined such that the thickness decreases by 25 μm (small compared to $G_B$ of 250 μm), from the evaporation rate of $2.2\times10^{-9}$ g/cm$^2$s, the lifetime is 1500 hours.

Another factor which may affect the grid lifetime is the fact that the grid is coated by $LaB_6$. This has been suppressed in the present design by the frame on main emitter surface. Also, because the grid is also at high temperature during operating, the condensation rate may not be high. The little deposited part can also be easily removed by heating the grid at high temperature (by laser heating) during non-operating time. Even this causes a little leaking current, it can be compensated by reducing $I_{DS}$.

For the same amount of emission current $I_M$, a larger area emitter can be chosen, and it can be operated at a lower temperature. Although this will cause some emittance growth, it will extend lifetime dramatically. For example, assuming that the main emitter temperature drops to 1700 K, the current density drops to ⅓ that of 1800 K, but the lifetime becomes one order longer.

Another consideration is beam emittance from the floating grid structure 200. The floating grid structure 200 provides a strong focusing near the cathode. This can help suppress the strong space charge near the cathode and correcting the phase space orientation of each beamlet, similar to the double-gate technique in a field emitter array. So, although the grid structure 200 breaks the uniformity of the beam 212, simulations indicate that the equivalent thermal energy of the beam 212 after the beam 212 leaves the grid structure 200 is less than 0.3 eV, better or equivalent to that of a photocathode.

In the above embodiments, methods have been described comprising: providing an RF cavity, a main emitter, a discharging emitter, and a floating grid that is in electrical contact with the discharging emitter; and electrically insulating the floating grid and the discharging emitter from the main emitter and the RF cavity when the RF cavity is not in operation.

The methods further comprise adjusting the DC bias of the floating grid so that the ending emission phase of the electron beam from the floating grid occurs earlier than the starting phase of back-bombardment of the electrons in the RF cavity, thereby suppressing the back-bombardment of the electrons.

In some embodiments, the methods and systems described above are used to reduce the general arc problems and breakdown issues associated with non-floating gridded cathodes. An example is to apply the floating grid in addition to the non-floating grid in the gun in an IOT. with 650 MHz frequency and CW output power.

Figure 5:
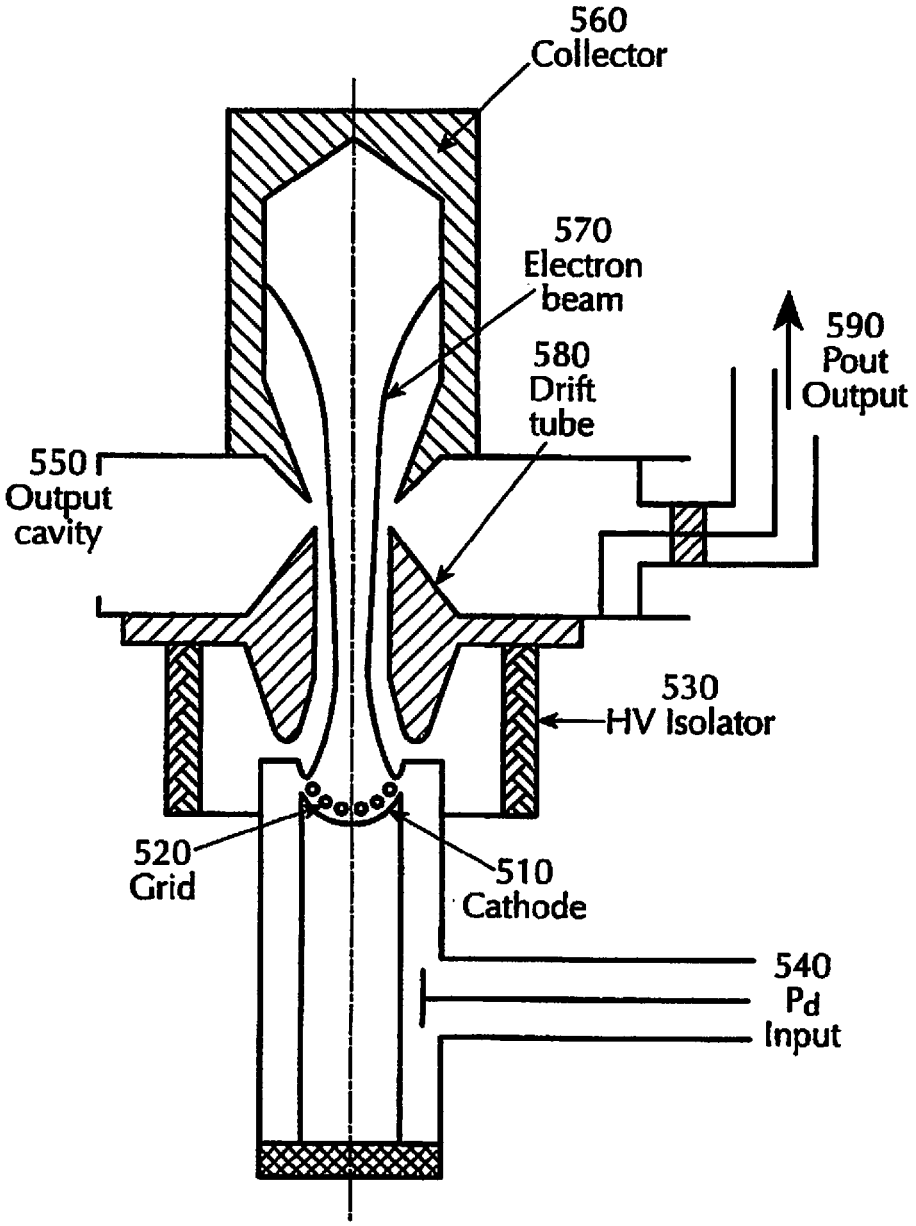
FIG. 5 PRIOR ART
FIG. 5 illustrates a conventional IOT (Inductive Output Tube), as known in the art.

FIG. 5 schematically illustrates a conventional IOT, known in the art. The IOT 500 includes a cathode 510, a grid 520, an input 540, an output cavity 550, a drift tube 580, and a collector 560. The power supplies and controllers for these components are all powered to a negative high voltage (−30 to −40 kV), with a ceramic high voltage isolator 530. The grid 520 is negatively biased relative to cathode 510 so that, during each RF cycle, the phase window of emission is less than 180° (usually ~90°). Such narrow emission window, combined with a multi-stage depressed collector 560, results in a high efficiency (70-80%).

The extracted bunched electrons from the gun form an electron beam 570, and gain energy from the DC field generated by the high voltage between the grounded anode and the cathode 510, as they pass through the drift tube 580. The electrons then deposit their energy by resonantly exciting the output cavity 550. This RF power is coupled out to the load through the output 590. Finally, the electrons are terminated by the ground referenced collector 560. Grounding the collector 560 instead of the cathode 510 simplifies cooling and output coupling.

The most common failure of an IOT comes from damage to the cathode 510 through internal arcing of the tube. The large stored energy from the high voltage power supply can destroy the cathode. Even when conventional protection techniques are used, the energy dissipated in each arc is still considerable. This arc reduces the lifetime of an IOT and can be catastrophic, requirement replacement of the cathode and the grid. Another issue that is common to all non-floating gridded tubes is the effect of the evaporated cathode material which condenses on the grid. This can cause the grid to arc to the anode and eventually create an electrically short between the cathode and the grid, requiring the tube to be rebuilt or ending the tubes lifetime.

In some embodiments of the present application, the floating grid structure described above is added to an IOT, to effectively suppress arcs and cathode material condensation in IOTs, thereby further improving the lifetime and reliability of IOT guns.

Figure 6:
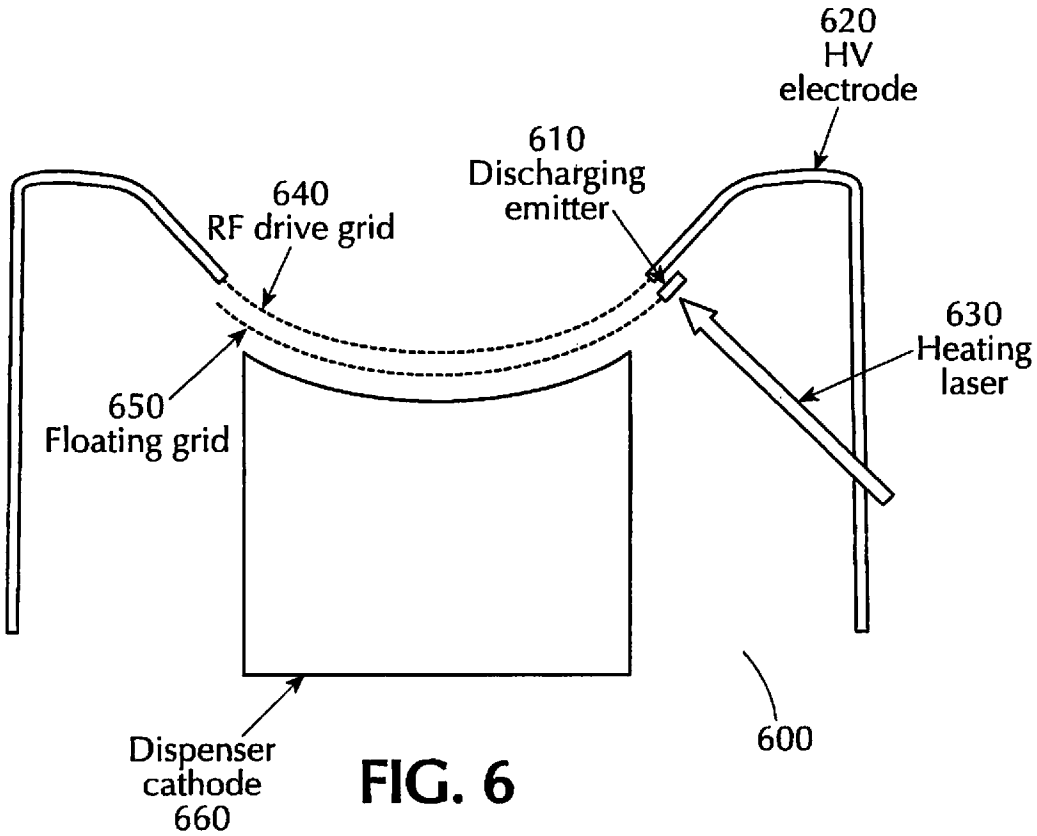
FIG. 6 illustrates a floating grid structure for an IOT, in accordance with some embodiments of the present application.

FIG. 6 illustrates one example of a floating grid structure 600 for an IOT, in accordance with some embodiments of the present application. In the illustrated embodiment, a floating grid 605, having an attached discharging emitter 612, is added between an RF drive grid 610 and a cathode 620. The floating grid 605 is electrically isolated from all ambient parts, except for the discharging emitter 612, which in the illustrated embodiment serves as a vacuum diode connection.

During operation, a fraction of the emitted electrons are captured by the floating grid 605 and charge up the floating grid 605, thus changing its DC bias relative to the cathode 620. As the DC bias of the floating grid 605 increases, it eventually stops cathode emission, unless the floating grid 605 is discharged. Once sufficient charge is removed from the floating grid 605, normal cathode emission can resume, dependent upon the presence of the external RF drive voltage. Such biasing of the floating grid 605 can control the electron emission phase in the same way as the original RF drive grid 610. Biasing the RF drive grid 610 is not necessary, because the floating grid 605 serves the same function. In some embodiments of the present application, however, biasing the RF drive grid 610 may be performed, however, to give more flexibility in controlling the beam.

The discharging of the floating grid 605 can be accomplished by several possible methods. For example, the discharging emitter material can be a thermionic cathode (such as a small dispenser cathode or a $LaB_6$ cathode) and a heating laser 630 can be introduced through an optical fiber to heat the cathode (i.e. discharging emitter 612) and initiate the emission. The emission of the thermionic cathode can also be activated through photo emission. For example, the work function of a $LaB_6$ cathode is about 2.7 eV and a laser with wavelength of less than 450 nm is enough to activate the emission. The discharge emitter 612 could also be a field emitter array. Whichever method is used, the charging and discharging currents must be balanced in steady-state operation. The nominal level of DC bias on the floating grid 605 is adjusted by changing the discharge current, for a fixed average charging current.

The discharging electron beam can go to a HV electrode 660, so that it does not affect the emission of the main cathode, namely the dispenser cathode 620. The dissipated power on the floating grid 605 by the charging electrons and the dissipated power to the HV electrode 660 by the discharging current are determined by the floating grid DC bias, the grid gaps, the input RF power, and are proportional to the charging and discharging currents. Reducing the discharging current could improve the lifetime of the discharging emitter 612 but requires reducing the charging current.

While a floating grid technique has been described above using an example of a CW amplifier having a power output of 50 kW, and a frequency of 650 MHz, such a technique can be applied, for example, to the gun of an IOT that produces an RF power output of up to about 100 kW, and a frequency of about up to 1.5 GHz.

A key benefit from adding a floating grid 605 is that it could effectively prevent an arc from the cathode 620. The floating grid 605 can prevent cathode arcing, because when arcing happens, it will charge up the floating grid 605 immediately, which will suppress further emission from the cathode.

Assuming that the size of the floating grid 605 is a few $cm^2$, and the cathode-floating grid and floating grid-driving grid gaps are about ¼ mm in length, the capacitance of the floating grid 605 to the ambient is about 10 pF. If the floating grid charging current jumps to 1 A due to an arc, it takes 1 ns to increase the floating grid bias by 100 V, neglecting discharging current change because it would be emission dominated. This is enough to stop further arcing. Higher current arcs would have faster suppression. This arc suppression is also bi-directional, i.e. takes place both from the cathode 620 to the floating grid 605, and from the driving grid 610 to the floating grid 605. In a conventional IOT, the arc current is shorted and arcing could sustain as long as the high voltage is engaged.

Another benefit of the floating grid 605 is that it could reduce or eliminate the cathode material condensing on the RF drive grid 610. In the conventional IOT, the grid temperature may be lower than the cathode temperature, allowing the condensation to accrete. In the above-described floating grid IOT, on the other hand, the floating grid 605 has an extra heating source, namely the heating laser 630. Therefore, its temperature could be higher and the accreting could be reduced or eliminated. When the discharging emitter 612 is a field emitter array or a photo emitter, the floating grid 605 can still be heated to higher temperature because of its thermal isolation from other parts.

In sum, methods and systems have been described relating to floating grid electron sources that are capable of generating high peak and high average current electron guns, by suppressing back-bombardment.

As described in previous sections, the floating grid technique can also solve the back-bombardment issue of a thermionic RF gun, and allows it to operate at CW mode for generating high-average current, low emittance, bunched beam. The large improvement on average current of a RF gun by the floating grid technique is of great significance to many accelerator related fields. This technique can be applied for cooling of ion beams, such as the CEBAF's e-cooling project, and RHIC, which are facilities that perform scientific research in nuclear physics.

The floating grid technique described above has the potential to dramatically improve the lifetime and reliability of IOTs, as described in conjunction with FIGS. 5 and 6.

The floating grid technique can also be applied other facilities requiring high peak and average current, such as the high average power Free Electron Lasers (FEL), including the Terahertz Sources which has many potential applications in medical imaging, security, and scientific use.

The components, steps, features, objects, benefits and advantages that have been disclosed are merely illustrative. None of them, nor the discussions relating to them, are intended to limit the scope of protection in any way. Numerous other embodiments are also contemplated, including embodiments that have fewer, additional, and/or different components, steps, features, objects, benefits and advantages.

Nothing that has been stated or illustrated is intended to cause a dedication of any component, step, feature, object, benefit, advantage, or equivalent to the public. While the specification describes particular embodiments of the present disclosure, those of ordinary skill can devise variations of the present disclosure without departing from the inventive concepts disclosed in the disclosure.

In the present application, reference to an element in the singular is not intended to mean "one and only one" unless specifically so stated, but rather "one or more." All structural and functional equivalents to the elements of the various embodiments described throughout this disclosure, known or later come to be known to those of ordinary skill in the art, are expressly incorporated herein by reference.

What is claimed is:

1. A system comprising:

an RF cavity; and a floating grid structure, including:

a main emitter;

a floating grid configured to capture a portion of the electron current emitted by the main emitter; and a discharging emitter in electrical contact with the floating grid and configured to discharge the floating grid;

wherein the floating grid and the discharging emitter are electrically insulated from the main emitter and the RF cavity, when the RF cavity is not in operation.

2. The system of claim 1, further comprising a discharging anode for the discharging emitter; and wherein the floating grid and the discharging emitter are electrically insulated from the discharging anode when the RF cavity is not in operation.

3. The system of claim 2, further comprising a charging emitter configured to charge the floating grid during an electron emission period in which the main emitter emits electrons; and wherein the floating grid and the discharging emitter are electrically insulated from the charging emitter when the RF cavity is not in operation.

4. The system of claim 2, wherein the current from the discharging emitter is controllable by adjusting one of:

The temperature of the discharging emitter;

the distance between the discharging emitter and the discharging anode; and the DC bias of the discharging anode.

5. The system of claim 2, wherein the floating grid and the discharging emitter are supported by one or more insulator materials.

6. The system of claim 5, wherein the temperature of the discharging emitter is controllable by at least one of: a laser beam whose average power is adjustable; conduction through temperature controlled support; and radiation from temperature controlled discharging anode.

7. The system of claim 3, wherein the DC bias of the floating grid is adjustable so as to make the ending emission phase of the electron beam from the floating grid in the RF cavity occur earlier, compared to the starting phase of back-bombardment of the electrons in the RF cavity, thereby suppressing the back-bombardment beam.

8. The system of claim 7, wherein the DC bias of the floating grid is adjustable by adjusting at least one of: electron current from the main emitter; electron current from the charging emitter;

and electron current from the discharging emitter.

9. The system of claim 3, wherein the current from the charging emitter is controllable by adjusting at least one of:

the temperature of the charging emitter;

the charging emitter gap; and the DC bias of the charging emitter.

10. The system of claim 3, wherein the main emitter, the charging emitter, and the discharging emitter are at least one of: a thermionic cathode; and a field emitter array.

11. The system of claim 1, wherein the starting phase of the electron back-bombardment in the RF cavity is more than 120 degrees; and wherein the peak energy initial phase of the RF cavity is more than 50 degrees.

12. The system of claim 1, wherein a design of the floating grid is a net pattern including grid contour and a mesh, and wherein the grid contour and mesh have one or more shapes comprising at least one of: a circle, a square, a concentric segment, and a slit.

13. The system of claim 1, wherein the floating grid is made of a high-temperature material comprising at least one of: carbon, tantalum, tungsten, and molybdenum.

14. The system of claim 13, wherein the main emitter is masked, at least in part, with a net having a same net pattern as the grid; and wherein the mask is made of a high-temperature material comprising at least one of: carbon, tantalum, tungsten, and molybdenum.

15. The system of claim 1, wherein an accelerating gap in a first cell of the RF cavity is no longer than about $\frac{1}{4}\lambda$.

16. The system of claim 1, wherein the starting phase of the electron back-bombardment in the RF cavity is more than 140 degrees; and wherein the peak energy initial phase of the RF cavity is more than 70 degrees.

17. The system of claim 1, wherein the starting phase of the electron back-bombardment in the RF cavity is more than 170 degrees; and wherein the peak energy initial phase of the RF cavity is more than 80 degrees.

18. The system of claim 1, further comprising a plurality of the floating grids.

19. The system of claim 1, wherein an accelerating gap in a first cell of the RF cavity is no longer than about $\frac{1}{5}\lambda$, $\frac{1}{20}\lambda$, or $\frac{1}{200}\lambda$.

20. An inductive output tube (IOT) comprising: a cathode; an RF drive grid; a floating grid disposed between the RF drive grid and the cathode; and a discharging emitter electrically connected to the floating grid and configured to discharge the floating grid; wherein the floating grid is electrically insulated from the RF drive grid and the cathode when the IOT is not in operation.

21. The inductive output tube of claim 20, wherein the floating grid is configured to capture at least a fraction of the electrons emitted from the cathode, so that the DC bias of the floating grid relative to the cathode can be adjusted, thereby suppressing arcing in the cathode.

22. A method comprising:

providing an RF cavity, a main emitter, a discharging emitter, and a floating grid that is in electrical contact with the discharging emitter; and electrically insulating the floating grid and the discharging emitter from the main emitter and the RF cavity, when the RF cavity is not in operation.

23. The method of claim 22, further comprising adjusting the DC bias of the floating grid so that the ending emission phase of the electron beam from the floating grid occurs earlier than the starting phase of back-bombardment of the electrons in the RF cavity, thereby suppressing the back-bombardment of the electrons.

* * * * *